US007963742B2

(12) United States Patent
Clouse et al.

(10) Patent No.: US 7,963,742 B2
(45) Date of Patent: Jun. 21, 2011

(54) VARIABLE COMPRESSOR STATOR VANE HAVING EXTENDED FILLET

(75) Inventors: Brian E. Clouse, Saugus, MA (US); Paul W. Baumann, Amesbury, MA (US); Becky E. Rose, Colchester, CT (US); Mark E. Simonds, Cape Neddick, ME (US)

(73) Assignee: United Technologies Corporation, Hartford, CT (US)

( * ) Notice: Subject to any disclaimer, the term of this patent is extended or adjusted under 35 U.S.C. 154(b) by 601 days.

(21) Appl. No.: 11/590,297

(22) Filed: Oct. 31, 2006

(65) Prior Publication Data

US 2008/0101935 A1 May 1, 2008

(51) Int. Cl.
*F04D 29/56* (2006.01)
*F03B 3/18* (2006.01)

(52) U.S. Cl. ..... 415/160; 415/191; 415/209.3

(58) Field of Classification Search ..... 415/160, 415/161, 191, 209.3
See application file for complete search history.

(56) References Cited

U.S. PATENT DOCUMENTS

| | | | | |
|---|---|---|---|---|
| 4,990,056 | A | 2/1991 | McClain et al. | |
| 5,593,275 | A | 1/1997 | Venkatasubbu et al. | |
| 6,283,705 | B1 * | 9/2001 | Rice et al. | 415/160 |
| 6,394,750 | B1 | 5/2002 | Hiskes | |
| 6,450,766 | B1 | 9/2002 | Honda | |
| 6,461,105 | B1 * | 10/2002 | Nicolson | 415/160 |
| 7,125,222 | B2 * | 10/2006 | Cormier et al. | 415/160 |
| 7,249,933 | B2 * | 7/2007 | Lee et al. | 416/97 R |
| 7,360,990 | B2 * | 4/2008 | Barbe et al. | 415/160 |

* cited by examiner

*Primary Examiner* — Ninh H Nguyen
*Assistant Examiner* — Sean J Younger
(74) *Attorney, Agent, or Firm* — Carlson, Gaskey & Olds PC

(57) ABSTRACT

An example variable stator vane assembly includes at least one button, a vane airfoil adjacent to the button, and a fillet defined between the button and the airfoil. In one example, the fillet defines a constant radius and extends beyond the button at least greater than a distance of 60% of a length of an overhang portion of the vane airfoil.

19 Claims, 6 Drawing Sheets

VARIABLE COMPRESSOR STATOR VANE HAVING EXTENDED FILLET

BACKGROUND OF THE INVENTION

This invention generally relates to gas turbine engines, and more particularly to a stator vane assembly having an extended fillet.

Gas turbine engines include high and low pressure compressors to provide compressed air for combustion within the engine. Both the high and low pressure compressors typically include multiple rotor discs. Stator vanes extend between each rotor disc along a compressor axis. Many gas turbine engine compressors include variable stator vanes which rotate about an axis which is transverse to the compressor axis. The rotation of the variable stator vanes about their axis regulates air flow and the compression of air within the compressor of the gas turbine engine during combustion.

As illustrated in FIG. 1, a variable stator vane 11 typically includes buttons 13 defined at each end (only one end shown) of the stator vane 11, which support the stator vane 11 ends on their flow path sides, and support trunnions 15 about which the stator vanes 11 rotate on their sides. Due to the limited amount of space available in the engine casing, the diameter of the buttons 13 is limited and often prevents the button 13 from supporting an entire vane airfoil 17. Therefore, a portion of the vane airfoil 17 overhangs a button end 23 (i.e. a vane overhang portion 19). The buttons 13 are received within holes in a casing wall which accommodate the rotation of the variable stator vanes 11.

An intersection area 21 between a button end 23 and the overhang portion 19 of the vane airfoil 17 may be unsupported by the stiff button 13. This is because the intersection area 21 defined between the button 13 and the vane airfoil 17 is supported by a strengthening fillet 25 which does not extend entirely along the vane overhang portion 19. Typically, the fillet 25 is a constant radius fillet and extends just aft of the button end 23. Therefore, a stiff-to-soft transition area is created near the intersection area 21. As a result, the overhang portion 19 of the vane airfoil 17 is highly susceptible to high vibrations from bending, and is also susceptible to high stresses. Disadvantageously, the high vibrations and high stresses located at the intersection area 21 between the button end 23 and the overhang portion 19 of the vane airfoil 17 may cause cracking and failure of the stator vane 11.

Several variable stator vane designs are known which reduce the susceptibility of the stator vane to cracks from high vibrations and high stresses. One known stator vane assembly includes local thickening in the intersection area between the button end and the overhang portion of the vane airfoil. The local thickening includes a thickness increase extending both forward (into the button) and aft (into the overhanging portion of the vane) approximately 60% of the length defined by the overhang portion. The thickening is provided to reduce both the vane's flexibility and vibration and the local stress concentration associated with the intersection. However, this approach disturbs airflow locally and forces airflow to detour around the thickened area until the airflow reaches the optimal location on the vane airfoil surface. An efficiency loss may be associated with the diversion of the airflow and may result in an even greater efficiency loss where the airflow becomes separated from the vane airfoil surface. In addition, there is a weight penalty associated with the added material needed to locally thicken the intersection area.

A second attempt to reduce the local stress concentration factor at the intersection area between the button end and the overhang portion of the vane includes an airfoil surface which is cut away locally at the intersection into the span of the vane airfoil. The goal is to increase the minimum radius of any inside corner of the stator vane. This stator vane design creates a large hole through the vane airfoil and allows a large amount of air leakage from the pressure side to the suction side of the compressor, which causes significant efficiency losses.

Attempts to mitigate the aerodynamic performance losses associated with the known stator vane designs mentioned above have been made by varying the corner radius at the intersection area (i.e. providing a variable radius fillet). However, this may cause the producability of the part to become challenging if not impossible.

Accordingly, it is desirable to provide an improved variable stator vane assembly that is simple to manufacture and that provides improved efficiency and increase strength at the intersection area between the button end and the overhang portion of the stator vane.

SUMMARY OF THE INVENTION

An example variable stator vane assembly includes at least one button, a vane airfoil adjacent to the button, and a fillet defined between the button and the airfoil. In one example, the fillet defines a constant radius and extends beyond the button at least greater than a distance of 60% of a length of an overhang portion of the vane airfoil.

An example compressor for a gas turbine engine includes a casing having a plurality of recesses and a plurality of stator vanes received within the recesses of the casing. Each stator vane includes a button, a vain airfoil and a fillet. The vane airfoil includes an overhang portion which extends between the button and a trailing edge of the vane airfoil. In one example, the fillet defines a constant radius and extends beyond the button at least greater than a distance of 60% of a length of the overhang portion of the vane airfoil.

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

Figure 1:
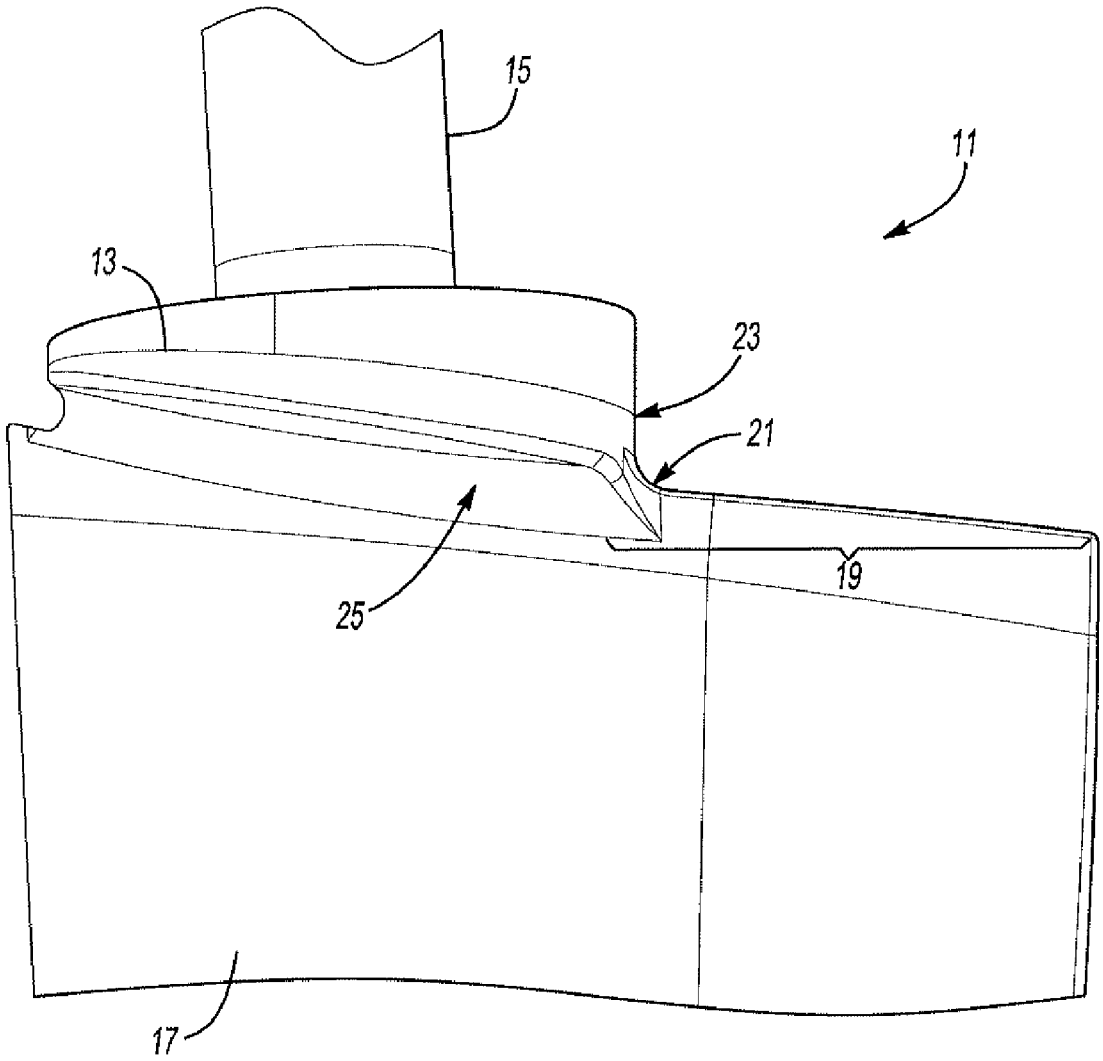
Fig-1 PRIOR ART
FIG. 1 illustrates a prior art variable stator vane.
Figure 2:
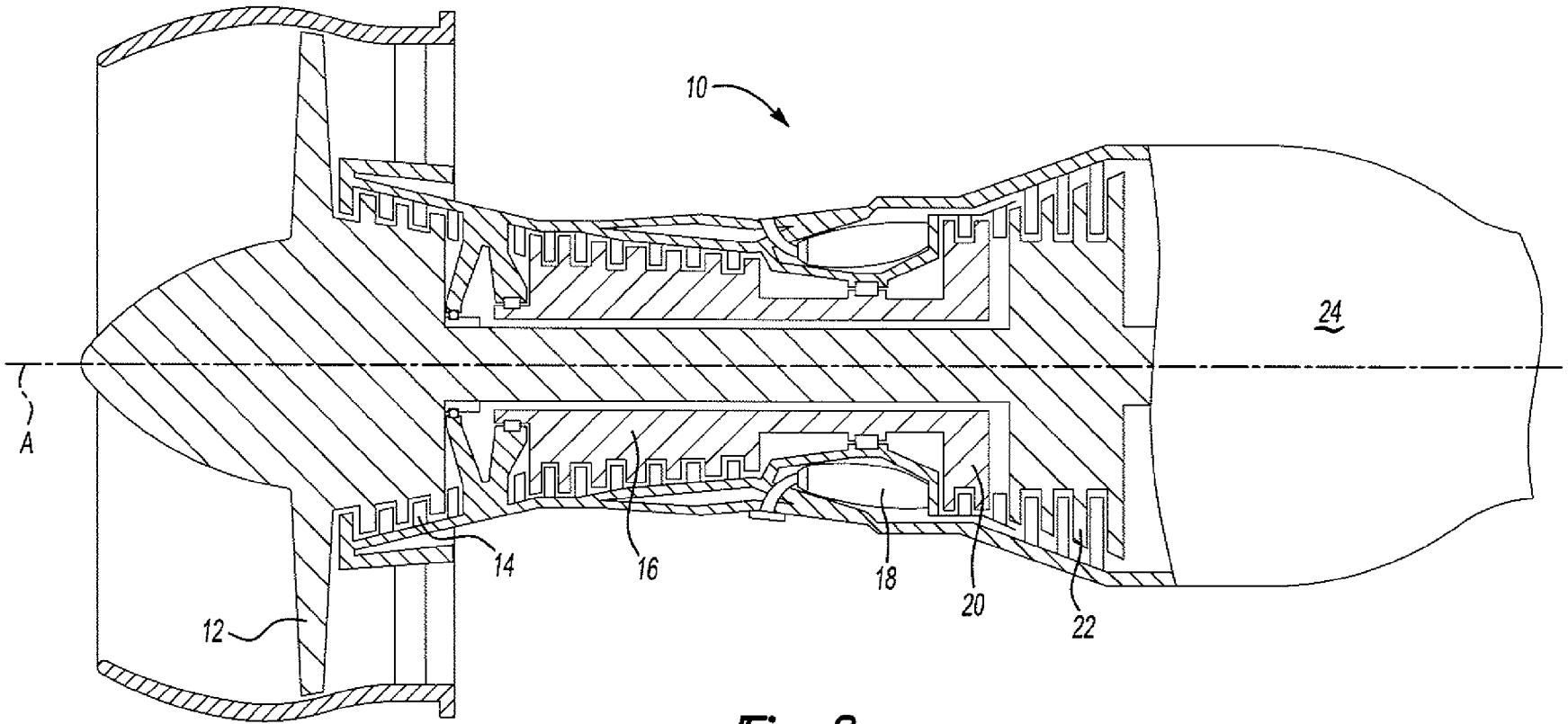
FIG. 2 is a cross-sectional view of a gas turbine engine.

Referring to FIG. 2, a gas turbine engine 10 includes a fan 12, a low pressure compressor 14, a high pressure compressor 16, a combustor 18, a high pressure turbine 20, a low pressure turbine 22, and an exhaust nozzle 24. The gas turbine engine 10 is defined about an engine center line A about which the various engine sections rotate. As is known, air is blown into the turbine engine 10 by fan 12 and flows through the low pressure compressor 14 and high pressure compressor 16. Fuel is mixed with the air and combustion occurs within the combustor 18. Exhaust from combustion flows through the high pressure turbine 20 and the low pressure turbine 22 prior to leaving the engine through the exhaust nozzle 24. Of course, this view is highly schematic. It should be understood, however, that the above parameters are only exemplary of a contemplated gas turbine engine. That is, the invention is applicable to other engine architectures.

Figure 3:
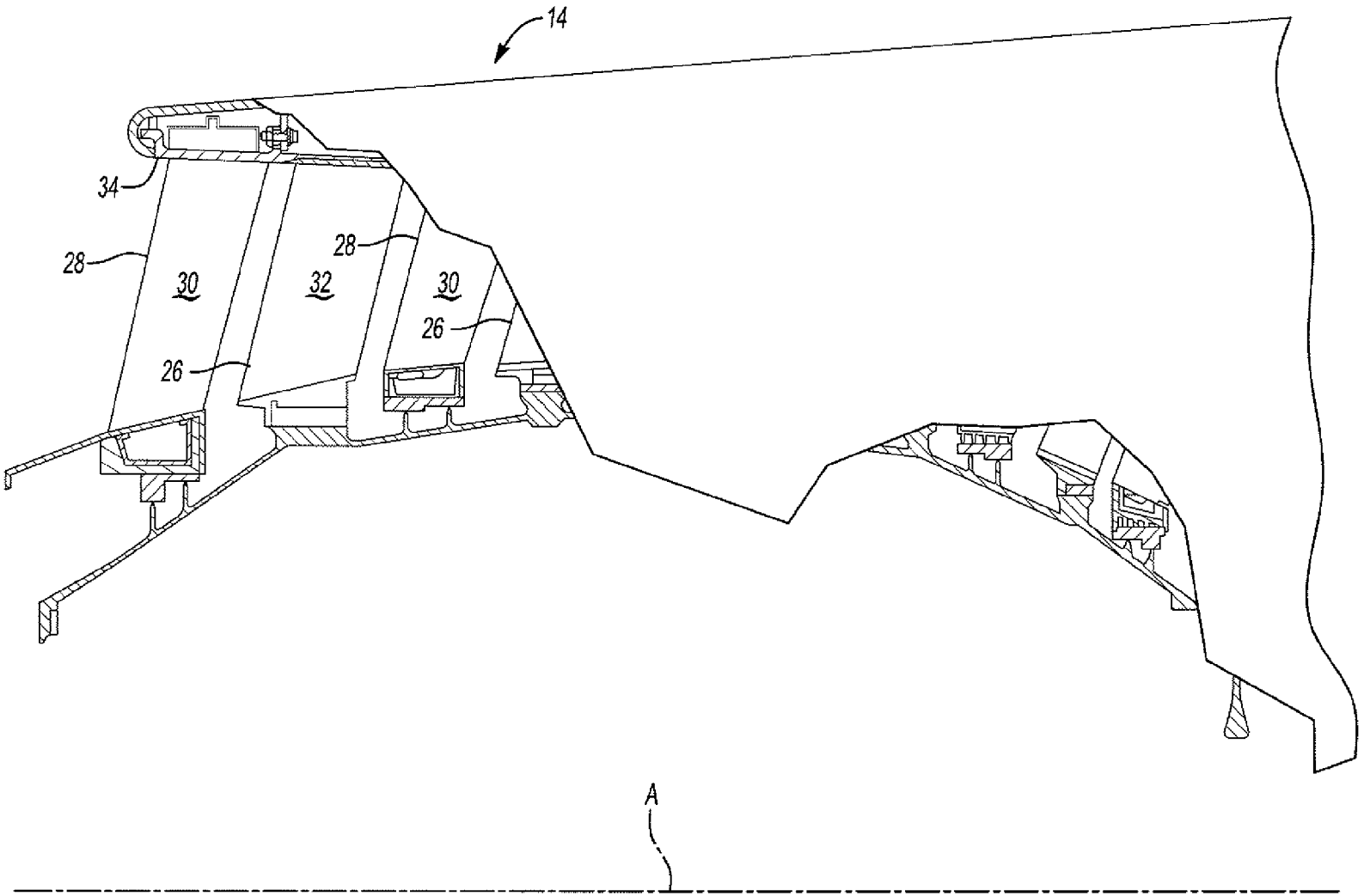
FIG. 3 illustrates a perspective view of compressor section of a gas turbine engine with portion cut away to illustrate alternating rows of rotor blades and stator blades.

Referring to FIG. 3, the low pressure compressor section 14 is shown partially broken away to illustrate alternating rows of rotor blades 26 and stator vanes 28. At least a portion of the stator vanes 28 are variable (rotatable) stator vanes. Each stator vane includes an airfoil 30 and each rotor blade 26 defines an airfoil 32. These rotor blades 26 rotate about the engine center line A in a known manner. The airfoils 30 extend inwardly from outer case 34 to direct the flow of working medium gases as the gases pass through the low pressure compressor 14.

Figure 4:
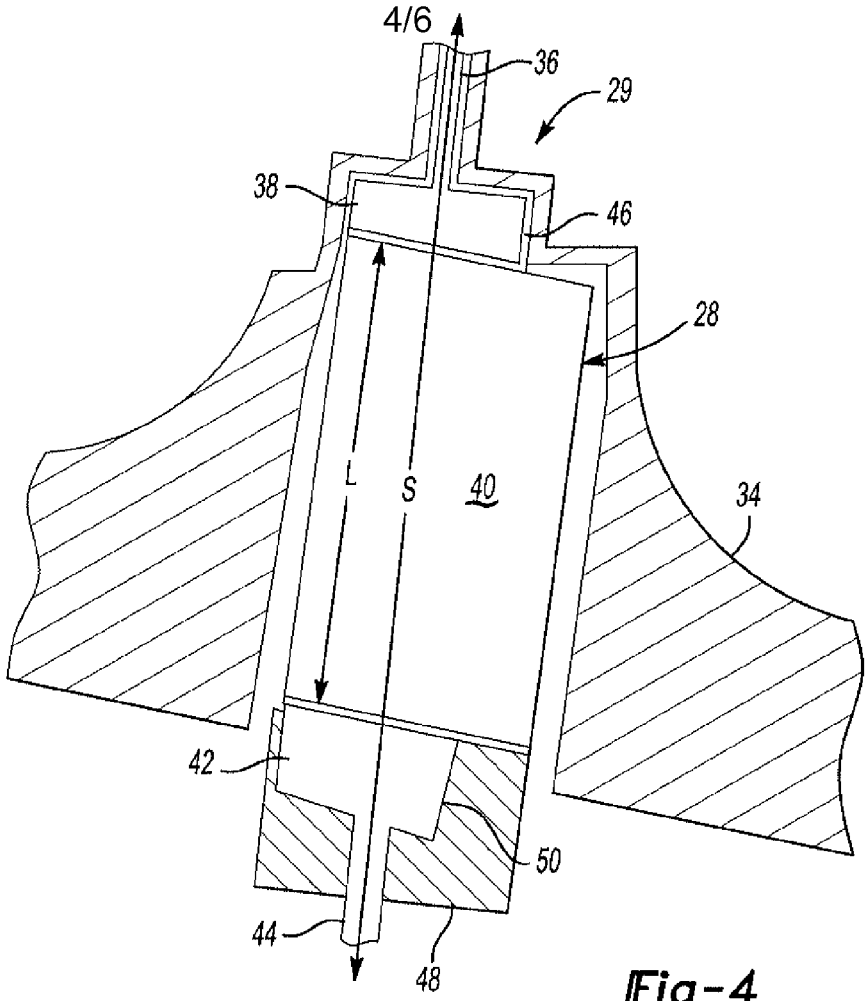
FIG. 4 illustrates a schematic view of a variable stator vane mounted within a casing.

Referring to FIG. 4, an example variable stator vane assembly 29 is illustrated. The variable stator vane 28 includes an outside diameter trunnion 36, an outside diameter button 38, a vane airfoil 40, an inside diameter button 42 and an inside diameter trunnion 44. The outer casing 34 defines a recess 46 for receiving the outside diameter trunion 36 and the outside diameter button 38 of the variable stator vane 28. The recess 46 accommodates the rotation of the variable stator vane 28 about a span-wise axis of rotation S. In one example, the span-wise axis of rotation S is perpendicular to the engine centerline A. However, the span-wise axis of rotation S may be positioned at any angle relative to the engine centerline A. An inner shroud 48 defines a recess 50 for each variable stator vane 28 and receives the inside diameter button 42 and inside diameter trunion 44 for accommodating the rotation of the variable stator vane 28 about the span-wise axis S. In one example, the vane airfoil 40 defines a length L. The outside diameter button 38 is positioned at one end of length L and the inside diameter button 42 is positioned at an opposing end of length L from button 38.

Figure 5:
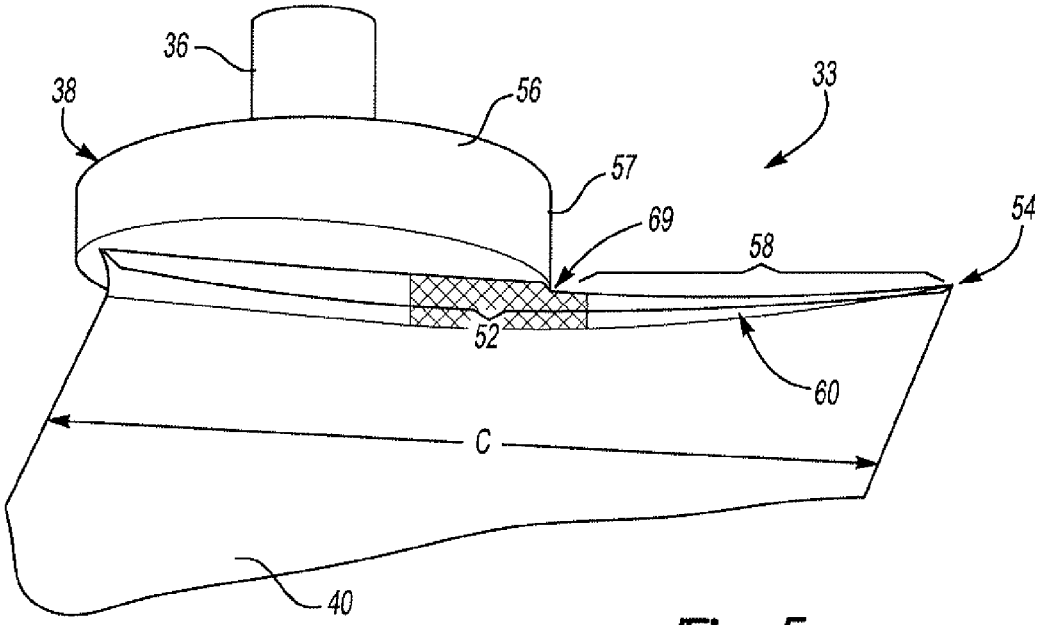
FIG. 5 illustrates a stator vane assembly having an extended fillet according to one example of the present invention.

Referring to FIG. 5, an example variable stator vane 33 for use within a stator vane assembly, such as the example stator vane assembly 29 as illustrated in FIG. 3, is illustrated. The variable stator vane 33 includes a fillet 52. The fillet 52 extends adjacent to a trailing edge 54 of the vane airfoil 40. In one example, the fillet 52 extends beyond the button 38 at least greater than a distance of 60% of a length defined by an overhang portion 58 defined by the vane airfoil 40, and in fact more than 90% of the length. In another example, the fillet 52 extends across an entire chord C defined by the vane airfoil 40. In yet another example, the fillet 52 extends entirely to the trailing edge 54 of the vane airfoil 40.

The fillet 52 defines a constant radius over more than 90% of its length, and in one embodiment over its entire length. The radius of a fillet refers to the size of the fillet. A cross-sectional slice through a fillet produces an arc, or a section of a circle. The radius of that circle is the radius of the fillet. If that radius is identical regardless of where a cross-sectional slice is taken along the fillet, the fillet has a constant radius rather than a variable radius. It should be understood that the actual radius of the fillet 52 will vary depending upon design specific parameters of the gas turbine engine 10 including the stiffness required to be provided between each button and vane airfoil of a stator vane.

The example button 38 includes a button face 56. Although the present example is disclosed in terms of the outside diameter button 38, it should be understood that the inside diameter button 42 could have similar features. The vane overhang portion 58 extends between a button end 57 and the trailing edge 54 and represents a portion of the vane airfoil 40 which is unsupported by the button 38. The button end 57 defines a corner 69 that represents an intersection area defined between the button 38 and the overhang portion 58 of the example stator vane 33.

The overhang portion 58 defines a cut surface 60. The cut surface 60 is a curved surface that permits airflow to easily transition from one side of the airfoil 40 to an opposite side thereof. That is, the cut surface 60 defines a surface of revolution. In addition, the cut surface 60 is required to prevent physical interference between the variable stator vane 33 and the outer casing 34 (or inner shroud 48) in which the variable stator vane 33 is mounted and rotates. The amount of space between the overhang portion 58 and the casing 34 or inner shroud 48 must be as minimal as possible to minimize air leakage (which reduces engine efficiency) from the pressure side (i.e. upstream side) to the suction side (i.e. downstream side) of the gas turbine engine 10.

The fillet 52 gradually decreases between the button end 57 and the trailing edge 54. Therefore, the amount of material added by the fillet 52 gradually disappears prior to reaching the trailing edge 54. The fillet 52 smoothes the passage of the airflow along the surface of the variable stator vane 33. Because the fillet 52 is not ended at the button end 57, there is no sudden local expansion of the airflow and no inducement for separation of the airflow from the vane airfoil 40. Further, the constant radius of the fillet 52 substantially reduces any local discontinuity at the vane airfoil/button interface, thereby reducing local stresses typically seen at the overhang portion 58 of the vane airfoil 40. In addition, the stiff-to-soft transition area between the button 38 and the overhang portion 58 is substantially reduced due to the extension of the fillet 52 to the trailing edge 54 of the variable stator vane 33.

Figure 6:
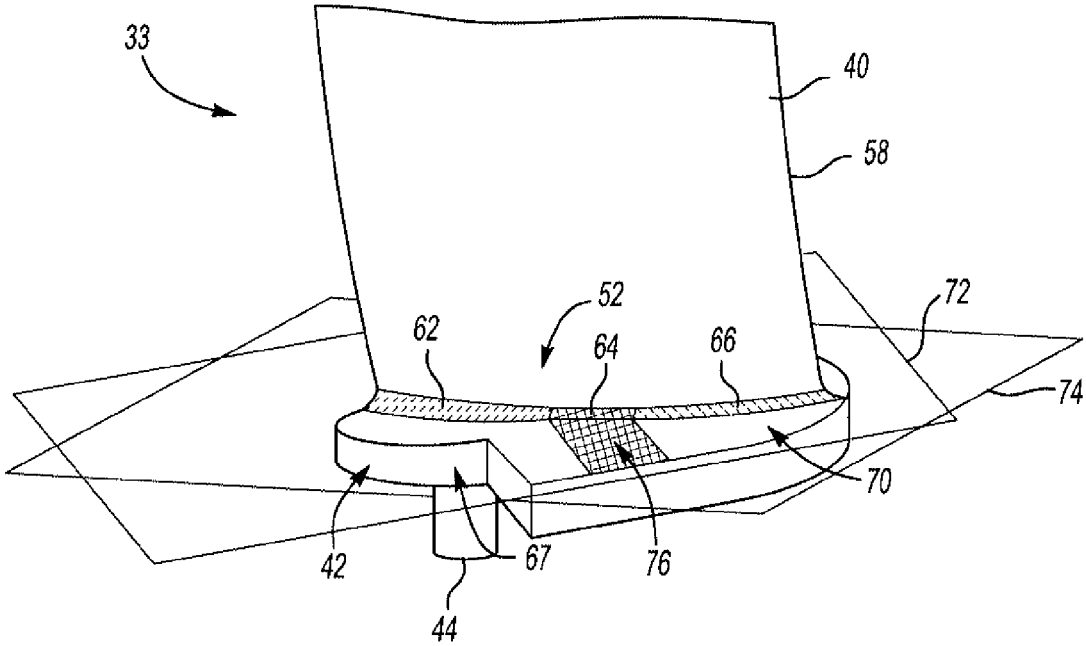
FIG. 6 illustrates an example stator vane assembly having an example construction surface for forming an extended fillet.
Figure 7:
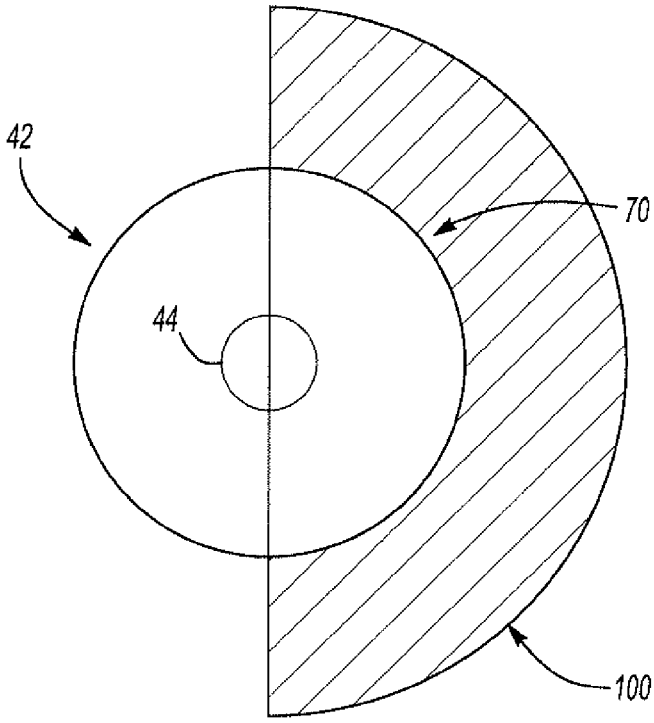
FIG. 7 is an end view of a button of an example stator vane having an extended fillet partially formed with the example construction surface.

Referring to FIGS. 6 and 7, the fillet 52 includes multiple portions. For example, the fillet 52 includes a vane-button fillet portion 62, a blend surface fillet portion 64, and a construction surface fillet portion 66. In the illustrated example, the vane-button fillet portion 62 is defined between the button 42 and the vane airfoil 40. Although the present example is shown and described with respect to the inner diameter button 42, it should be understood that a similar configuration would be used for the outer diameter button 38. In one example, the fillet 52 is tangent to a button face 68 of the inner diameter button 42 and to the vane airfoil 40. Therefore, the vane-button fillet portion 62 is easily constructed between the button 42 and the vane airfoil 40. That is, because the vane-button fillet portion 62 is tangent to two surfaces, the vane-button fillet portion 62 may be easily manufactured with a constant radius.

The construction surface fillet portion 66 of the fillet 52 is associated with the overhang portion 58 of the variable stator vane 33. In that area, without the stiffening provided by the button 42, the construction surface fillet portion 66 is defined and located geometrically between the vane airfoil 40 and a construction surface 70. The construction surface 70 is required to locate the fillet 52 away from a button end 67 of button 42, but still adjacent to and tangent to the vane airfoil 40 (i.e., such that the fillet is tangent to two surfaces).

In one example, the construction surface 70 is at least partially disposed within a first surface 72, such that the construction surface 70 exists only in space on a completed stator vane part (See FIG. 6). For illustrative purposes, the first surface 72 is shown as a plane. Portions of the construction surface 70 may be present during the manufacturing process of the variable stator vane 33, although the construction surface 70 is not required. For example, the construction surface 70 may be comprised of metal during production of the variable stator vane 33, wherein the metal is removed subsequent to production. However, all of (or portions of) the construction surface 70 may be included on the final part.

The construction surface fillet portion 66 is defined between the vane airfoil 40 and an edge 100 of the construction surface 70 (See FIG. 6). In one example, the construction surface 70 is planar. In another example, the construction surface 70 comprises a curve. It should be understood that the example construction surface 70 may include any geometric construction surface capable of providing the ability to provide a second surface for locating the construction surface fillet portion 66 along the overhang portion 58 of the vane airfoil 40.

A second surface 74 is defined by the button 42. The second surface 74 is shown as a plane for illustrative purposes. In one example, the second surface 74 is transverse to the first surface 72 defined by the construction surface 70. The angular relationship between the first surface 72 and the second surface 74 will vary depending upon the size of the variable stator vane 33 and other design specific parameters associated with the gas turbine engine 10. Therefore, the actual geometry of the construction surface fillet portion 66 may be parametrically varied by altering the shape and relationship of the construction surface 70 relative to the button 42. The gradual decrease of the fillet 52 between the button end 67 and the trailing edge 54 of the stator vane 33 is located and defined along the overhang portion 58 based upon the angular relationship between the first surface 72 and the second surface 74.

The blend surface fillet portion 64 is positioned adjacent to button end 67 of the button 42 (i.e. near the intersection area defined between the button 42 and the vane airfoil 40). In one example, the blend surface fillet portion 64 is defined between the vane-button fillet portion 62 and the construction surface fillet portion 66 to provide a smooth transition therebetween. In addition, the blend surface fillet portion 64 connects the button 42 to the construction surface 70.

A transition surface 76 connects the vane-button fillet portion 62 to the blend surface fillet portion 64. The transition surface 76 is preferably blended, such as with a simple radius, to provide a smooth transition surface between the vane-button fillet portion 62 and the blend surface fillet portion 64 and to avoid placing a corner across the flow path which may disrupt airflow along the intersection area between the vane airfoil 40 and the button 40. The blend surface fillet portion 64 follows the contour defined by the radius of the transition surface 76 to connect the vane-button fillet portion 62 to the construction surface fillet portion 66. The actual size of the transition surface 76 will depend upon design specific parameters of the variable stator vane 33.

The foregoing description shall be interpreted as illustrative and not in any limiting sense. A worker of ordinary skill in the art would recognize that certain modifications would come within the scope of this invention. For that reason, the following claims should be studied to determine the true scope and content of this invention.

Figure 8:
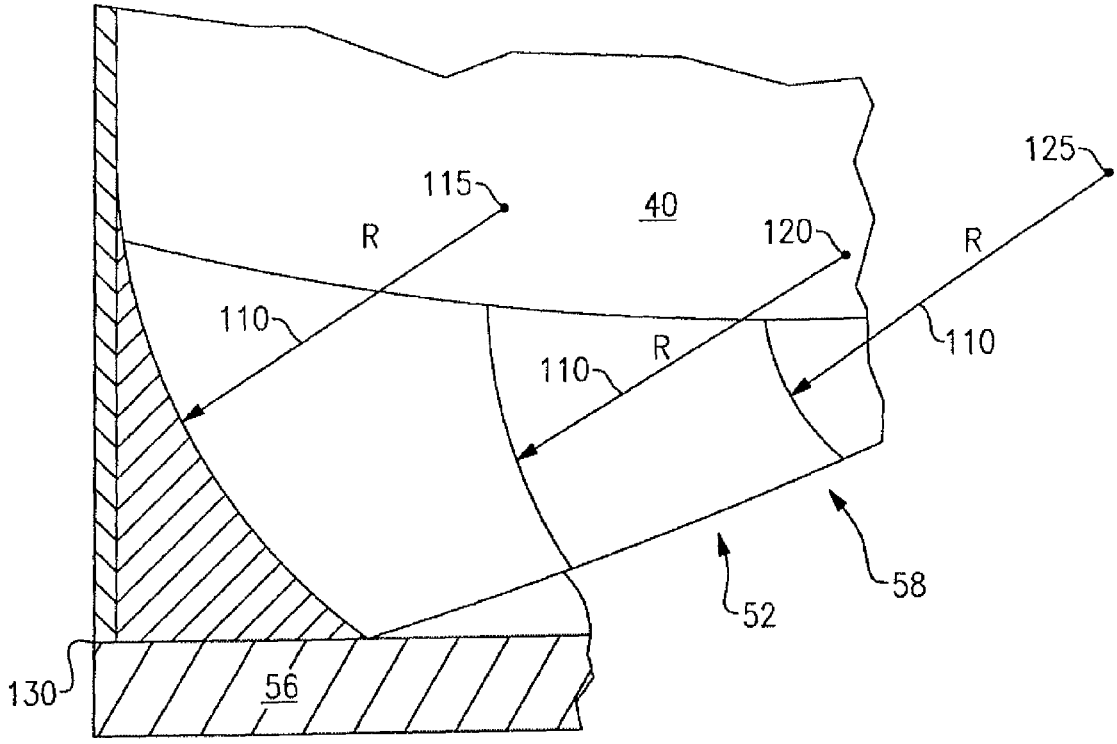
FIG. 8 illustrates a cut-away, perspective view of a button, fillet having a constant radius and a vane.

FIG. 8 shows a button 56, airfoil 40 and fillet 52. The fillet is tangent e.g., "touches" to the button and to the airfoil. A constant length radius R emanates from radius points 115, 120, and 125 to define a fillet having a constant radius R at different cross-sections across the vane. Referring to FIG. 5, the blade does not have a winglet at either end thereof and does not have a fillet in contact with the winglet over the overhang portion 58. The fillet attaches at an end 130 of the airfoil along the overhang portion 58.

What is claimed is:

1. A variable stator vane assembly, comprising:

at least one button; and a vane airfoil adjacent to said at least one button, said vane airfoil having an overhang portion extending beyond said at least one button; and a fillet touching said at least one button and touching said vane airfoil along an edge of said airfoil, wherein said fillet defines a constant radius and extends beyond said at least one button at least greater than a distance of 60% of a length of said overhang portion of said vane airfoil.

2. The assembly as recited in claim 1, wherein said fillet defines a vane-button fillet portion, a blend surface fillet portion and a construction surface fillet portion.

3. The assembly as recited in claim 2, wherein said vane-button fillet portion is defined between said at least one button and said vane airfoil.

4. The assembly as recited in claim 3, wherein said construction surface fillet portion is defined between said vane airfoil and a construction surface, wherein said construction surface is defined in space by at least one of a plane and a curve.

5. The assembly as recited in claim 1, wherein said fillet extends beyond said at least one button at least greater than a distance of 90% of said length of said overhang portion of said vane airfoil.

6. The assembly as recited in claim 1, wherein said fillet extends to said trailing edge of said vane airfoil.

7. The assembly as recited in claim 1, wherein said constant radius of said fillet is defined over 100% of its length.

8. The assembly of claim 1 wherein said fillet attaches to an end of said airfoil at said overhang portion of said airfoil.

9. A compressor for a gas turbine engine, comprising:

a casing defining a plurality of recesses; and a plurality of stator vanes each received within at least a portion of said plurality of recesses of said casing, wherein each of said plurality of stator vanes includes at least one button, a vane airfoil and a fillet touching said at least one button and touching said vane airfoil along an edge of said airfoil, wherein said fillet defines a constant radius and extends beyond said at least one button at least greater than a distance of 60% of a length of an overhang portion of said vane airfoil.

10. The assembly as recited in claim 9, wherein said overhang portion does not touch said button.

11. The assembly as recited in claim 9, wherein said fillet defines a vane-button fillet portion, a blend surface fillet portion and a construction surface fillet portion.

12. The assembly as recited in claim 11, wherein said vane-button fillet portion is defined between said at least one button and said vane airfoil.

13. The assembly as recited in claim 12, wherein said construction surface fillet portion is defined between said vane airfoil and a construction surface, wherein said construction surface is defined in space by at least one of a plane and a curve.

14. The assembly as recited in claim 9, wherein said fillet extends beyond said at least one button at least greater than a distance of 90% of said length of said overhang portion of said vane airfoil.

15. The assembly as recited in claim 9, wherein said fillet extends to said trailing edge of said vane airfoil.

16. The assembly as recited in claim 9, wherein said constant radius of said fillet is defined over 100% of its length.

17. The assembly of claim 9 wherein said fillet attaches to an end of said airfoil at said overhang portion of said airfoil.

18. The assembly of claim 15 wherein said fillet diminishes along its length beyond said button.

19. The assembly of claim 5 wherein said fillet diminishes along its length beyond said button.

* * * * *